US005465449A

United States Patent [19]

Lewkowicz

[11] Patent Number: 5,465,449

[45] Date of Patent: Nov. 14, 1995

[54] DENTURE BRUSH

[75] Inventor: Martin Lewkowicz, Upper Montclair, N.J.

[73] Assignee: Ranir/DCP Corporation, Grand Rapids, Mich.

[21] Appl. No.: 329,461

[22] Filed: Oct. 26, 1994

Related U.S. Application Data

[63] Continuation-in-part of Ser. No. 28,424, Sep. 14, 1994.

[51] Int. Cl.[6] ..... A46B 5/02; A46B 9/04

[52] U.S. Cl. ..... 15/106; 15/143.1; 15/167.1

[58] Field of Search ..... 15/106, 143.1, 15/167.1–167.3; D4/104–106, 119, 120, 130, 132–134, 136, 138

[56] References Cited

U.S. PATENT DOCUMENTS

| | | | |
|---|---|---|---|
| D. 75,971 | 8/1928 | Faubert . | |
| D. 96,749 | 9/1935 | Hellonen . | |
| D. 128,681 | 8/1941 | Reinold | D4/107 |
| D. 213,669 | 4/1969 | Miller . | |
| D. 233,961 | 12/1974 | Crawford | D4/105 |
| D. 292,348 | 10/1987 | Roberts et al. | D4/132 |
| D. 322,171 | 12/1991 | Grunerg et al. | D4/105 |
| D. 334,288 | 3/1993 | Witzig-Jaggi | D4/104 |
| 335,345 | 2/1886 | Estabrook | 15/167.1 |
| D. 347,736 | 6/1994 | Schneider et al. | D4/104 |
| 835,709 | 11/1906 | Miller | 15/143.1 |
| 1,696,433 | 12/1928 | Faubert et al. | 15/167.1 |
| 2,190,277 | 2/1940 | Viragh | 15/106 |
| 2,206,542 | 7/1940 | Arnold | 15/106 |
| 2,236,034 | 3/1941 | Luce et al. | 15/106 |
| 2,263,885 | 11/1941 | McGauley | 15/143.1 |
| 2,267,670 | 12/1941 | Rosenwasser | 15/143.1 |
| 2,464,321 | 3/1949 | Konczal | 15/167.1 |
| 2,511,235 | 6/1950 | Arwood | 15/143.1 |
| 2,934,776 | 5/1960 | Clemens | 15/167.1 |
| 3,067,447 | 12/1962 | Birch | 15/167.2 |
| 3,732,973 | 5/1973 | Crawford | 15/167.1 |
| 4,274,174 | 6/1981 | Ertel | 15/143.1 |
| 4,517,701 | 5/1985 | Stanford, Jr. | 15/106 |
| 4,598,437 | 7/1986 | Ernest et al. | 15/167.1 |
| 5,052,071 | 10/1991 | Halm | 15/143.1 |
| 5,230,117 | 7/1993 | Johnson et al. | 15/106 |
| 5,331,704 | 7/1994 | Rosen et al. | 15/167.1 |
| 5,365,881 | 11/1994 | Sporn | 15/143.1 |

FOREIGN PATENT DOCUMENTS

| | | | |
|---|---|---|---|
| 76598 | 11/1953 | Denmark | 15/167.1 |
| 91-07114 | 5/1991 | WIPO | 15/167.1 |

*Primary Examiner*—Mark Spisich

*Attorney, Agent, or Firm*—Price, Heneveld, Cooper, DeWitt & Litton

[57] ABSTRACT

A brush, particularly a denture brush particularly advantageous for persons of limited or diminished dexterity, comprising an elongated handle having a front, a back and a pair of sides, a bristle head on one end of the handle, the handle having a narrowed neck joining the bristle head to the remainder of the handle, having a narrowed distal end and having a bulbous enlarged central portion between the narrowed neck and the narrowed distal end, a tapered juncture between the narrowed neck and the bristle head, forming a sloped front zone and a sloped back zone, both having finger tip or thumb tip receiving depressions therein, the bristle head having a front bristle face including bristles therein generally normal to the sloped back zone, and having a rear bristle face including bristles therein generally normal to the sloped front zone, the sloped front zone and back zone having a friction material in the depressions. The neck has four such depressions and the head has three, for gripping at a variety of brush orientations.

11 Claims, 3 Drawing Sheets

DENTURE BRUSH

RELATED APPLICATION

This application is a continuation-in-part application of copending application entitled BRUSH, filed Sep. 14, 1994, Ser. No. 29/028,424, pending.

BACKGROUND OF THE INVENTION

This invention relates to brushes and particularly to denture brushes.

Denture brushes of a variety of configurations have been proposed heretofore, with some of these designs having been marketed. In the process of cleaning items such as dentures, considerable scrubbing force is often necessary for effective cleaning. Yet the shape and material of conventional brushes do not readily lend themselves to this. Such brushes are particularly difficult to use effectively by persons with limited or diminished manual dexterity due to age, arthritis, tremors or the like.

SUMMARY OF THE INVENTION

One object of this invention is to provide a unique brush configuration particularly suited for a denture brush which provides optimum grip by a person's hand for vigorous scrubbing of dentures or the like. The brush can be effectively held by a person with limited or diminished manual dexterity. The handle is configurated to have thumb tip or finger tip receiving zones at several positions so that the handle or the head may be readily gripped for use. The handle is bulbous, with friction grip surfaces. It enables maximum potential pressure application to the object being cleaned, by either set of the alternate bristles on the front and back of the head of the brush and from different angles. Yet it also has an attractive aesthetic appearance.

These and other objects, advantages and features of the novel brush will become apparent upon review of the following detailed specification in conjunction with the drawings.

DESCRIPTION OF THE PREFERRED EMBODIMENT

Referring now specifically to the drawings, a denture brush 10 is there depicted, this brush having an elongated, bulbous handle 12 including a front 12*a*, a back 12*b*, and a pair of sides 12*c* and 12*d*. The cross section of the brush handle in any particular area basically comprises a rectangle, with the individual rectangular cross sections being of different size and configuration over the length of the handle. A bristle head is on one end of handle 12, with handle 12 having a narrowed neck 12*e* integrally joining the bristle head 14 to the handle 12. On opposite lateral sides of neck 12*e* are concavities 12*h* and 12*j*. The handle also has a narrowed distal end 12*f*. Between the narrowed neck and the distal end is a bulbous, enlarged central portion 12*g*.

Figure 9:
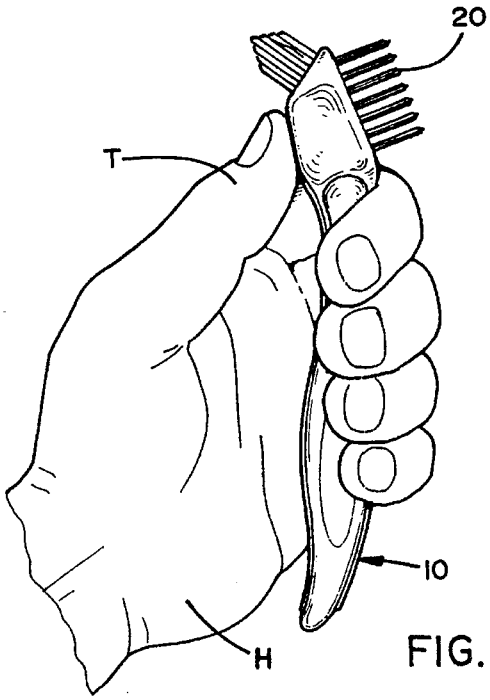
FIG. 9 is a side elevational view of the brush, and a hand with the thumb engaging the back of the head.
Figure 10:
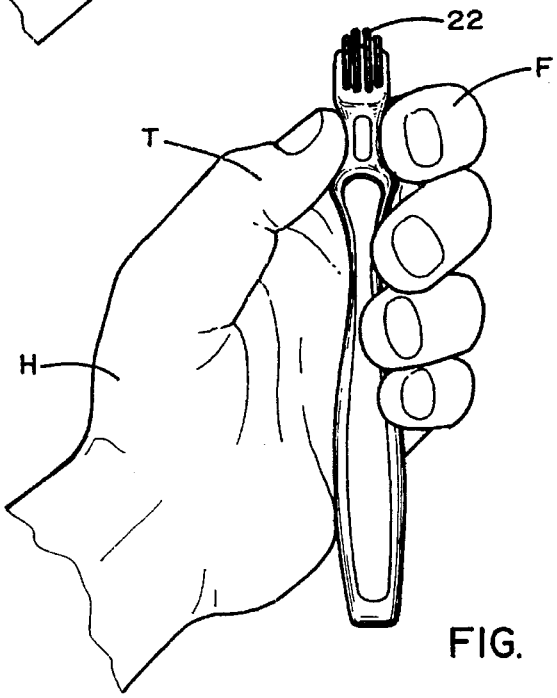
FIG. 10 is a rear elevational view of the brush, and a hand with the thumb engaging a side of the head.

Between the narrowed neck 12*e* and the bristle head 14 is a tapered junction which includes a sloped front zone 16 and a sloped rear zone 18. Front zone 16 has a concave depression, i.e., concavity, 16*a* therein while rear zone 18 also has a concave depression, i.e., concavity, 18*a* therein. The two opposite sides of head 14 also have concavities 14*b* and 14*c*. These depressions or concavities are to selectively receive a person's thumb tip or finger tip, as depicted in FIGS. 9 and 10. Depression 16*a* includes a friction material strip 26 therein while depression 18*a* also includes a friction material strip 28 therein. This friction material may be a thin layer of polymeric rubber or the equivalent bonded to the brush. Preferably this friction material extends all the way from zone 16 to the distal end of the front of the brash, and from zone 18 to the distal end of the back of the brush for excellent manual grip of the bulbous brush handle. The main body, i.e., handle, neck and head, of the brush is preferably of an integrally molded polymer.

The bristle head 14 has a front bristle face 14*a* which is at an obtuse angle to sloped zone 16. This front face has bristle receiving orifices extending into the bristle head 14 generally normal to face 14*a*, to receive the inner ends of front bristles 20 which protrude from head 14 generally normal to rear zone 18. Front bristle face 14*a* is generally parallel to sloped zone 18.

Head 14 also includes a rear bristle face 14*b* which is generally parallel to front sloped zone 16, having a plurality of bristle receiving orifices extending generally normal to face 14*b* into head 14 to receive the inner ends of a plurality of rear bristles 22. Bristles 22 thus extend generally normal to front sloped zone 16.

The distal end 12*f* of handle 12 curves over a large radius of curvature toward the back of the brush as shown at 13.

Figure 1:
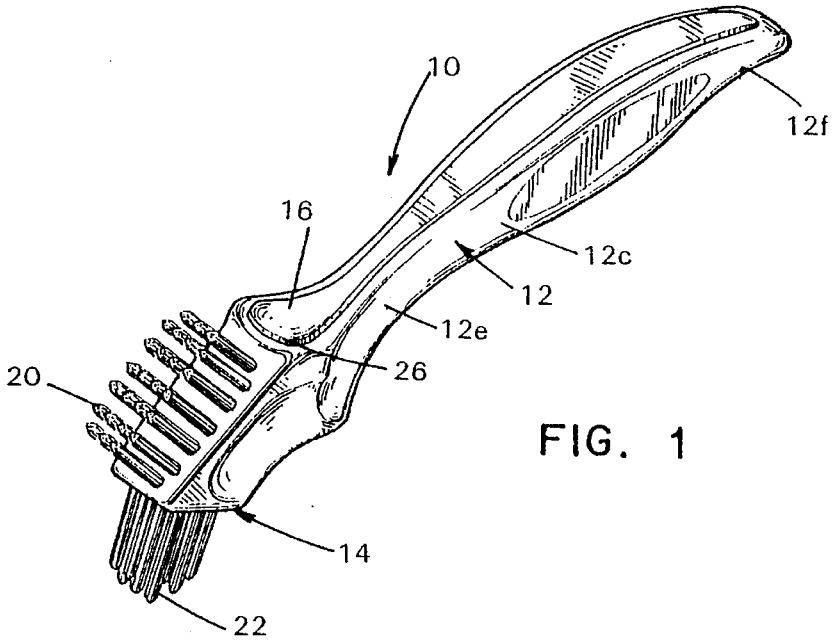
FIG. 1 is a perspective view of the novel brush.
Figure 2:
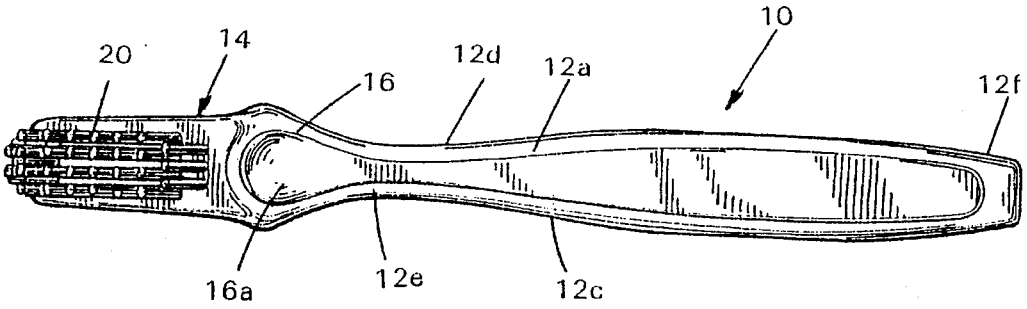
FIG. 2 is a front elevational view of the brush.
Figure 3:
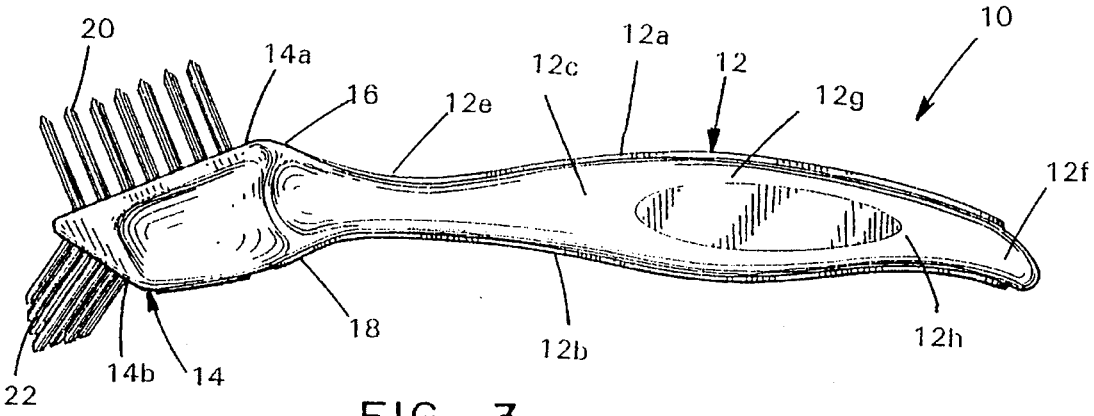
FIG. 3 is a side elevational view of the brush.
Figure 4:
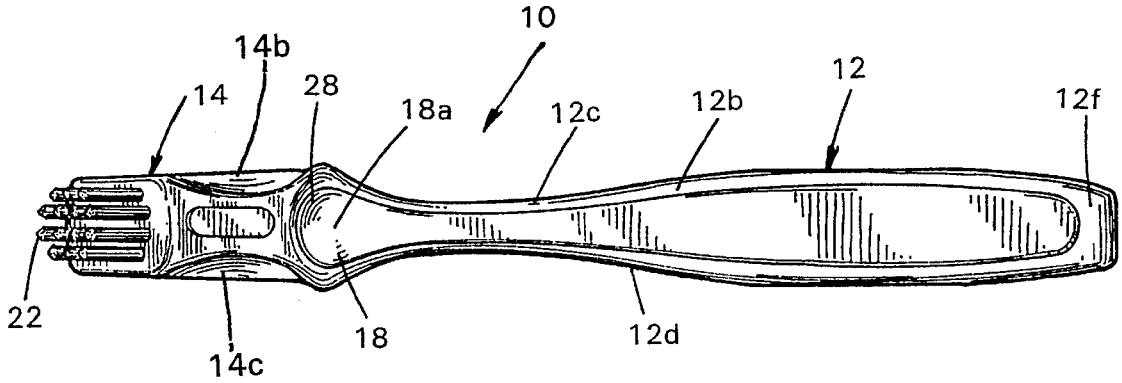
FIG. 4 is a back elevational view of the brush.
Figure 5:
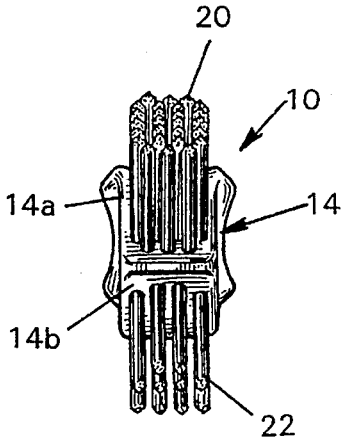
FIG. 5 is an end elevational view of the brush viewed from the bristle head end.
Figure 6:
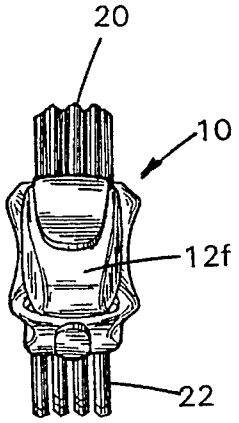
FIG. 6 is an end elevational view of the brush viewed from the distal end.
Figure 7:
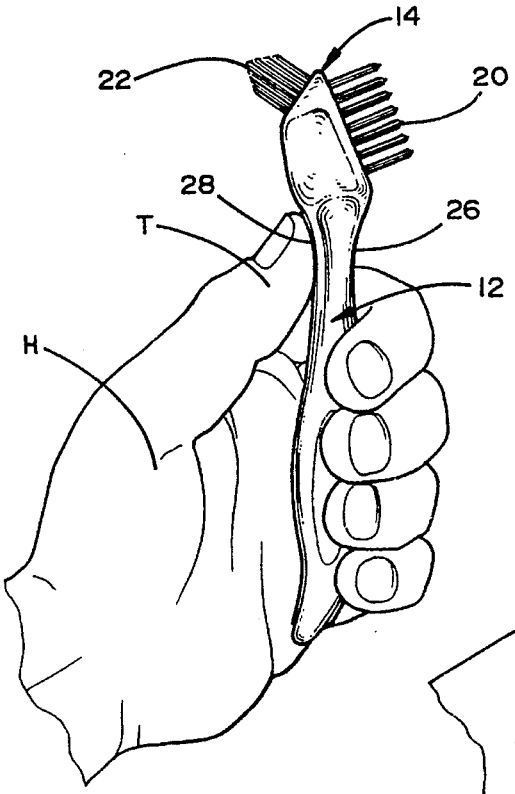
FIG. 7 is an elevational view of the side of the brush, and a hand gripping the brush handle with a thumb on the front.
Figure 8:
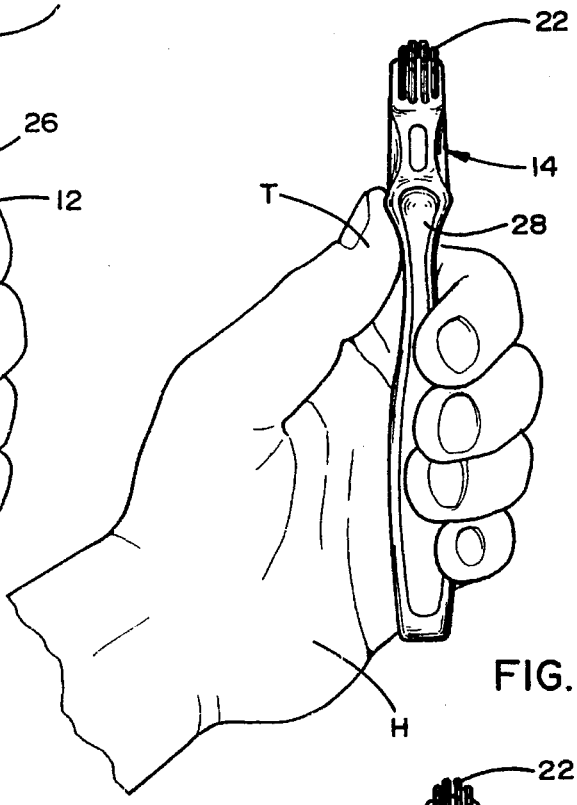
FIG. 8 is a rear elevational view of the brush, and a hand gripping the handle with a thumb on the side.

The unique brush may be used in a variety of grips. In FIG. 7 is depicted one grip, with hand H holding the bulbous handle and thumb T against the friction strip 28 on the handle. In FIG. 8, hand H holds the brush with thumb T in side concavity 12*h*. In FIG. 9, hand H holds the brush with thumb T in head concavity 16*a*. In FIG. 10, hand H holds the brush with thumb T and the index finger F in opposite side concavities 14*b* and 14*c*.

Because of the features described above and shown on the drawings, the denture brush is particularly easy to employ, enabling effective scrubbing type cleaning to be performed on dentures or other articles. The handle is bulbous with the friction material to improve use by people with limited or diminished manual dexterity due to age, arthritis, tremors, etc. by affording a solid non-slip mass for gripping. The handle is equally effective for use by right or left handed individuals. The head and neck concavities provide additional points at which the user can grasp the brush in various orientations. While the common method of use of denture brushes is to hold the handle, many people with limited or diminished manual dexterity grasp the head of a denture brush in order to gain better control. The concavities in the head and neck provide contoured areas which guide placement of the user's thumb and forefinger while bracing the brush with the contour of the handle nested in the palm and middle, right and pinky fingers. There are seven contoured areas for thumb and forefinger positioning, four in the neck and three on the head.

Various advantages and features not specifically recited will likely be apparent to those in this art. It is also conceivable that minor variations may be made in the preferred embodiment depicted and described, without departing from the inventive concept. Therefore, it is intended that the invention is not to be limited to the specific preferred embodiment depicted, but only by the scope of the appended claims and the reasonably equivalent structures to those defined therein.

The embodiments of the invention in which an exclusive property or privilege is claimed are defined as follows:

1. A brush comprising:

an elongated handle having a front, a back and a pair of sides;

a bristle head on one end of said handle;

said handle having a narrowed neck joining said bristle head to said handle, having a narrowed distal end and having a bulbous enlarged central portion between said narrowed neck and said narrowed distal end;

a tapered juncture between said narrowed neck and said bristle head, forming a sloped front zone and a sloped back zone, said sloped front zone and said sloped back zone having finger and thumb tip receiving depressions therein; and said bristle head having a front bristle face including bristles therein generally normal to said sloped back zone, and having a rear bristle face including bristles therein generally normal to said sloped front zone.

2. The brush in claim 1 wherein said sloped front zone and said sloped back zone have a friction material in said depressions.

3. The brush in claim 1 wherein said distal end of said handle has a curve toward said back.

4. The brush in claim 1 wherein said front and said back have friction material strips thereon.

5. A brush comprising:

an elongated handle having a front, a back and a pair of sides;

a bristle head on one end of said handle and having a pair of sides;

said handle having a neck joining said bristle head to said handle, having a distal end and having a central portion between said neck and said distal end;

a juncture between said neck and said bristle head, forming a sloped front zone and a sloped back zone;

finger and thumb tip receiving depressions in said front zone, said back zone, and in both said sides of said head; and said bristle head having a front bristle face including bristles generally normal to said sloped back zone, and having a rear bristle face including bristles generally normal to said sloped front zone.

6. The brush in claim 5 wherein said sloped front zone and said sloped back zone have a friction material in said depressions.

7. The brush in claim 5 wherein said distal end of said handle has a curve toward said back.

8. The brush in claim 5 wherein said head has a rear face with a depression therein.

9. A brush comprising:

an elongated handle having a front, a back and a pair of sides;

a bristle head on one end of said handle and having a pair of sides;

said handle having a neck joining said bristle head to said handle, having a distal end and having a central portion between said neck and said distal end;

said neck having a pair of opposite lateral sides with finger and thumb receiving depressions therein;

a juncture between said neck and said bristle head, forming a sloped front zone and a sloped back zone; and said bristle head having a front bristle face including bristles generally normal to said sloped back zone, and having a rear bristle face including bristles generally normal to said sloped front zone.

10. A brush comprising:

an elongated handle having a front, a back and a pair of sides;

a bristle head on one end of said handle;

juncture between said handle and said bristle head, forming a sloped back zone, said juncture including a sloped front zone, and said bristle head having a rear bristle face including bristles generally normal to said sloped front zone;

said bristle head having a front bristle face including bristles generally normal to said sloped back zone; and said sloped back zone having a thumb or finger tip receiving concavity.

11. The brash in claim 10 having a friction material in said concavity.

* * * * *

UNITED STATES PATENT AND TRADEMARK OFFICE

CERTIFICATE OF CORRECTION

PATENT NO. : 5,465,449
DATED : November 14, 1995
INVENTOR(S) : Martin Lewkowicz

It is certified that error appears in the above-indentified patent and that said Letters Patent is hereby corrected as shown below:

Column 2, line 24;
"brash" should be – brush –;

Column 4, line 38, claim 10;
Before "juncture" insert – a –;

Column 4, line 47, claim 11;
"brash" should be – brush –.

Signed and Sealed this

Twenty-eighth Day of May, 1996

*Attest:*

BRUCE LEHMAN

*Attesting Officer*

*Commissioner of Patents and Trademarks*